US011011008B2

(12) United States Patent
Yokoo

(10) Patent No.: US 11,011,008 B2
(45) Date of Patent: May 18, 2021

(54) SHEET HANDLING MACHINE AND SHEET HANDLING METHOD

(71) Applicant: GLORY LTD., Hyogo (JP)

(72) Inventor: Tomohiro Yokoo, Himeji (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 16/199,932

(22) Filed: Nov. 26, 2018

(65) Prior Publication Data

US 2019/0164374 A1 May 30, 2019

(30) Foreign Application Priority Data

Nov. 27, 2017 (JP) ..... JP2017-226790

(51) Int. Cl.

| | |
|---|---|
| ***G07D 11/12*** | (2019.01) |
| ***G07D 11/00*** | (2019.01) |
| ***G07D 11/16*** | (2019.01) |
| ***B65H 31/24*** | (2006.01) |
| ***B65H 31/10*** | (2006.01) |

(Continued)

(52) U.S. Cl.

CPC ..... *G07D 11/009* (2013.01); *B65H 31/10* (2013.01); *B65H 31/24* (2013.01); *B65H 31/3018* (2013.01); *B65H 33/08* (2013.01); *B65H 39/115* (2013.01); *G07D 11/12* (2019.01); *G07D 11/16* (2019.01); *G07D 11/18* (2019.01); *G07D 11/20* (2019.01); *G07D 11/34* (2019.01); *B65H 31/22* (2013.01); *B65H 2301/4217* (2013.01); *B65H 2301/422548* (2013.01); *B65H 2701/182* (2013.01); *B65H 2701/1912* (2013.01)

(58) Field of Classification Search

CPC .. G07D 11/0093; G07D 11/009; G07D 11/12; G07D 11/16; B65H 31/24

See application file for complete search history.

(56) References Cited

U.S. PATENT DOCUMENTS 3,851,773 A * 12/1974 Kluge ..... B65H 33/08 414/788.3

4,905,839 A 3/1990 Yuge et al.

(Continued)

FOREIGN PATENT DOCUMENTS

| | | |
|---|---|---|
| JP | H0375895 | 3/1991 |
| JP | 2000222627 | 8/2000 |
| WO | 2016136517 A1 | 9/2016 |

OTHER PUBLICATIONS

Extended European Search Report in counterpart European Application No. 18208561.3, dated Apr. 25, 2019.

(Continued)

*Primary Examiner* — Thomas A Morrison

(74) *Attorney, Agent, or Firm* — Greenblum & Bernstein, P.L.C.

(57) ABSTRACT

In a sheet handling machine (for example, a banknote handling machine) including a plurality of mounting units, a controlling unit controls a transporting unit and temporary storage units to perform parallel processing mode such that a storage operation for sending a sheet held by a first temporary storage unit among the plurality of temporary storage units to a storage member (for example, a banknote storage bag) and a transport operation for transporting the sheet from the transporting unit to a second temporary storage unit different from the first temporary storage unit are performed in parallel.

11 Claims, 9 Drawing Sheets

(51) Int. Cl.

| | |
|---|---|
| ***B65H 31/30*** | (2006.01) |
| ***B65H 39/115*** | (2006.01) |
| ***G07D 11/18*** | (2019.01) |
| ***B65H 33/08*** | (2006.01) |
| ***G07D 11/34*** | (2019.01) |
| ***G07D 11/20*** | (2019.01) |
| *B65H 31/22* | (2006.01) |

(56) References Cited

U.S. PATENT DOCUMENTS

| | | | | |
|---|---|---|---|---|
| 8,997,438 | B1 * | 4/2015 | Fallas | B65G 47/914<br>414/222.01 |
| 9,045,309 | B2 * | 6/2015 | Hashimoto | B65H 31/22 |
| 2004/0003980 | A1 * | 1/2004 | Hallowell | B65B 27/08<br>194/206 |
| 2018/0029730 | A1 | 2/2018 | Yokoo | |

OTHER PUBLICATIONS

European Office Action in counterpart European Application No. 18 208 561.3-1009, dated Jan. 14, 2020.
European Office Action in counterpart European Application No. 18 208 561.3-1009, dated Jun. 23, 2020.

* cited by examiner

SHEET HANDLING MACHINE AND SHEET HANDLING METHOD

CROSS-REFERENCE TO RELATED APPLICATION

This application claims priority to Japanese Patent Application No. 2017-226790 filed on Nov. 27, 2017, the entire contents of which are incorporated herein by reference.

BACKGROUND OF THE INVENTION

1. Field of the Invention

The present invention relates to a sheet handling machine and sheet handling method for storing sheets such as banknotes inside a storage member, for example, a storage bag and storage cassette.

2. Description of the Related Art

As a sheet handling machine for performing deposit processing of sheets such as banknotes, there has been conventionally used one in which the sheets taken in into a housing are stored in a storage bag. For example, International Patent Publication WO2016/136517 disclose such a sheet handling machine. Such a sheet handling machine is used as a part of a cash handling machine installed in a back office area of a store such as a supermarket, specifically, as a banknote handling machine. The cash handling machine dispenses money as change fund to be replenished in a cash settlement machine installed in a front office area, and deposits money as proceeds from sales collected from the cash settlement machine.

SUMMARY OF THE INVENTION

In the conventional sheet handling machine as disclosed in WO2016/136517, a mounting unit to which the storage bag is detachably mounted is disposed, and a temporary storage unit is disposed above the mounting unit for temporarily holding the sheets before the sheet is stored in the storage bag. Also, the temporary storage unit is connected to the transporting unit, and the sheets are sent from the transporting unit to the temporary storage unit. When the conventional sheet handling machine performs storage processing for storing the sheets in the storage bag mounted to the mounting unit, the sheets to be stored in the storage bag are first sent from the transporting unit to the temporary storage unit and then the sheets are temporarily held in this temporary storage unit. When a predetermined number of sheets are held in the temporary storage unit, the sheets temporarily held in the temporary storage unit are sent collectively to the storage bag mounted to the mounting unit, and the sheets are stored in the storage bag. When the storage processing is completed, new sheets to be stored in the storage bag are sent to the temporary storage unit.

However, in the sheet handling method as described above, while the sheets held in the temporary storage unit are stored in the storage bag, new sheets can not be sent from the transporting unit to the temporary storage unit. For this reason, it takes a long time to store the sheets in the storage bag.

The present invention has been made in consideration of the above-mentioned points, and it is an object of the present invention to provide a sheet handling machine and sheet handling method that can shorten the time for storing sheets in a storage member.

A sheet handling machine of the present invention comprises: a plurality of mounting units, to each of the plurality of mounting units a storage member for storing a sheet being detachably mounted; a transporting unit configured to transport the sheet; a plurality of temporary storage units respectively connected to the transporting unit and disposed so as to correspond to the respective mounting units, the plurality of temporary storage units temporarily holding the sheet sent from the transporting unit before the sheet is stored in the storage member mounted to each mounting unit; and a controlling unit configured to control the transporting unit and temporary storage units to perform parallel processing mode such that a storage operation for sending the sheet held by a first temporary storage unit among the plurality of temporary storage units to the storage member and a transport operation for transporting the sheet from the transporting unit to a second temporary storage unit different from the first temporary storage unit are performed in parallel.

In the sheet handling machine of the present invention, the controlling unit may control the transporting unit to send the sheet from the transporting unit to each temporary storage unit such that banknotes of a plurality of denominations are stored in a mixed state in each of the storage members mounted to each mounting unit.

In the sheet handling machine of the present invention, the storage member may comprise a storage bag provided with an opening, and each mounting unit comprises a holding member for holding a portion of the storage bag near the opening of the storage bag.

In this case, the sheet handling machine of the present invention may further comprise a pushing unit configured to enter an inside of the storage bag held by the holding member and push the sheet stored in the storage bag, and the storage operation may comprise an operation of pushing the sheet stored in the storage bag by the pushing unit entering the inside of the storage bag.

Further, the sheet handling machine of the present invention may further comprise a placement unit that is movable in a first direction in which the pushing unit enters the inside of the storage bag and pushes the sheet stored in the storage bag and on which at least a portion of the storage bag held by the holding member is placed, and the storage operation may comprise an operation of moving the placement unit in the first direction.

In the sheet handling machine of the present invention, the storage member may comprise a storage cassette, and each mounting unit is provided with an accommodating space for accommodating the storage cassette.

In the sheet handling machine of the present invention, each of the temporary storage units may be arranged above the storage member mounted to the corresponding mounting unit, each temporary storage unit may comprises a temporary storage member which is rotatable about a shaft, the sheet sent from the transporting unit to each temporary storage unit may be stacked on the temporary storage member, and the storage operation may comprise an operation for sending the sheet to the storage member mounted to the mounting unit, by dropping the sheet stacked on the temporary storage member as the temporary storage member rotates about the shaft.

In the sheet handling machine of the present invention, the controlling unit may control the transporting unit and the temporary storage unit to perform the parallel processing mode when a predetermined condition based on the number of sheets sent from the transporting unit to the first temporary storage unit is satisfied.

In the sheet handling machine of the present invention, the controlling unit may perform hold processing mode such that the transport operation is performed to send the sheet from the transporting unit to the second temporary storage unit while the first temporary storage unit holds the sheet sent from the transporting unit to the first temporary storage unit, and a setting unit may be capable of setting any of the parallel processing mode and the hold processing mode.

In this case, the controlling unit may perform the hold processing mode when a predetermined condition based on the number of sheets sent from the transporting unit to the first temporary storage unit is satisfied.

A sheet handling method of the present invention performed by a sheet handling machine including a plurality of mounting units, to each mounting unit a storage member for storing sheet being detachably mounted, a transporting unit configured to transport the sheet, and a plurality of temporary storage units respectively connected to the transporting unit and disposed so as to correspond to the respective mounting units comprises: sending the sheet from the transporting unit to a first temporary storage unit among the plurality of temporary storage units and temporarily holding the sheet before being stored in the storage member mounted to the mounting unit by the first temporary storage unit; and performing a storage operation for sending the sheet held by the first temporary storage unit among the plurality of temporary storage units to the storage member and a transport operation for transporting the sheet from the transporting unit to a second temporary storage unit different from the first temporary storage unit in parallel, when a predetermined condition based on the number of sheets sent from the transporting unit to the first temporary storage unit is satisfied.

BRIEF DESCRIPTION OF THE DRAWINGS

FIG. 4 is a perspective view showing a configuration of a banknote storage bag to be held by each holding member of the banknote storage mechanism shown in FIG. 2 and the like.

FIG. 5 is a perspective view showing a state in which the banknote storage bag is held by each holding member of the banknote storage mechanism shown in FIG. 2 and the like.

FIG. 9 is a functional block diagram showing a configuration of a control system of the banknote handling machine shown in FIG. 1 and the like.

DESCRIPTION OF THE PREFERRED EMBODIMENTS

Figure 4:
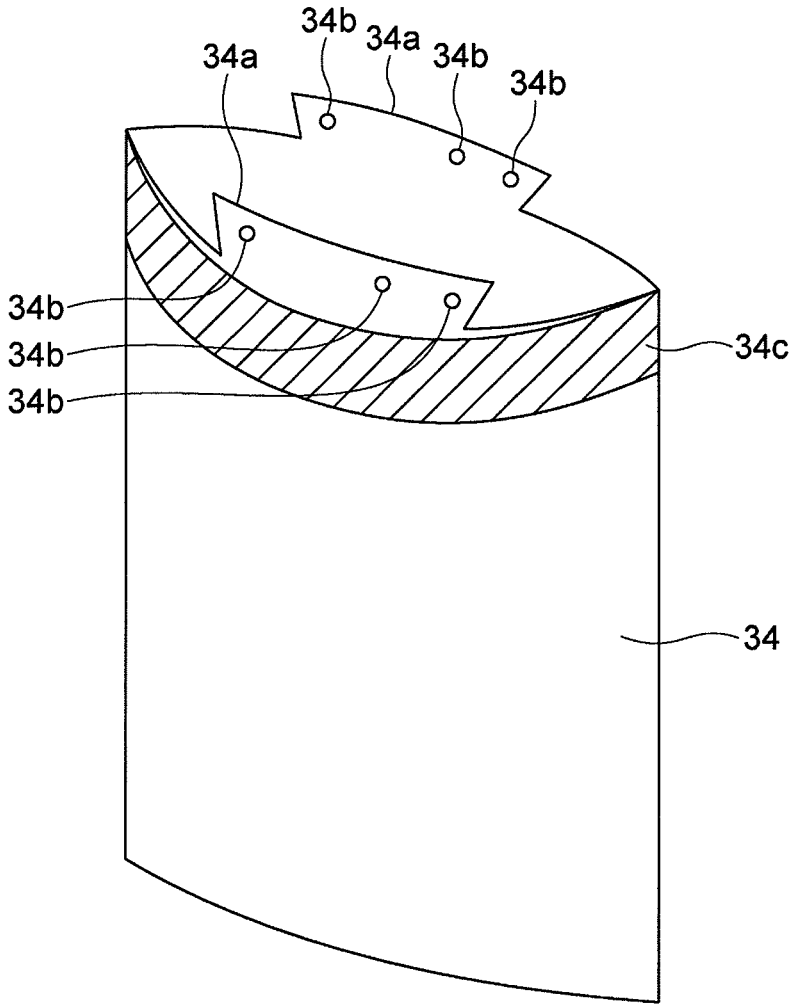
Figure 5:
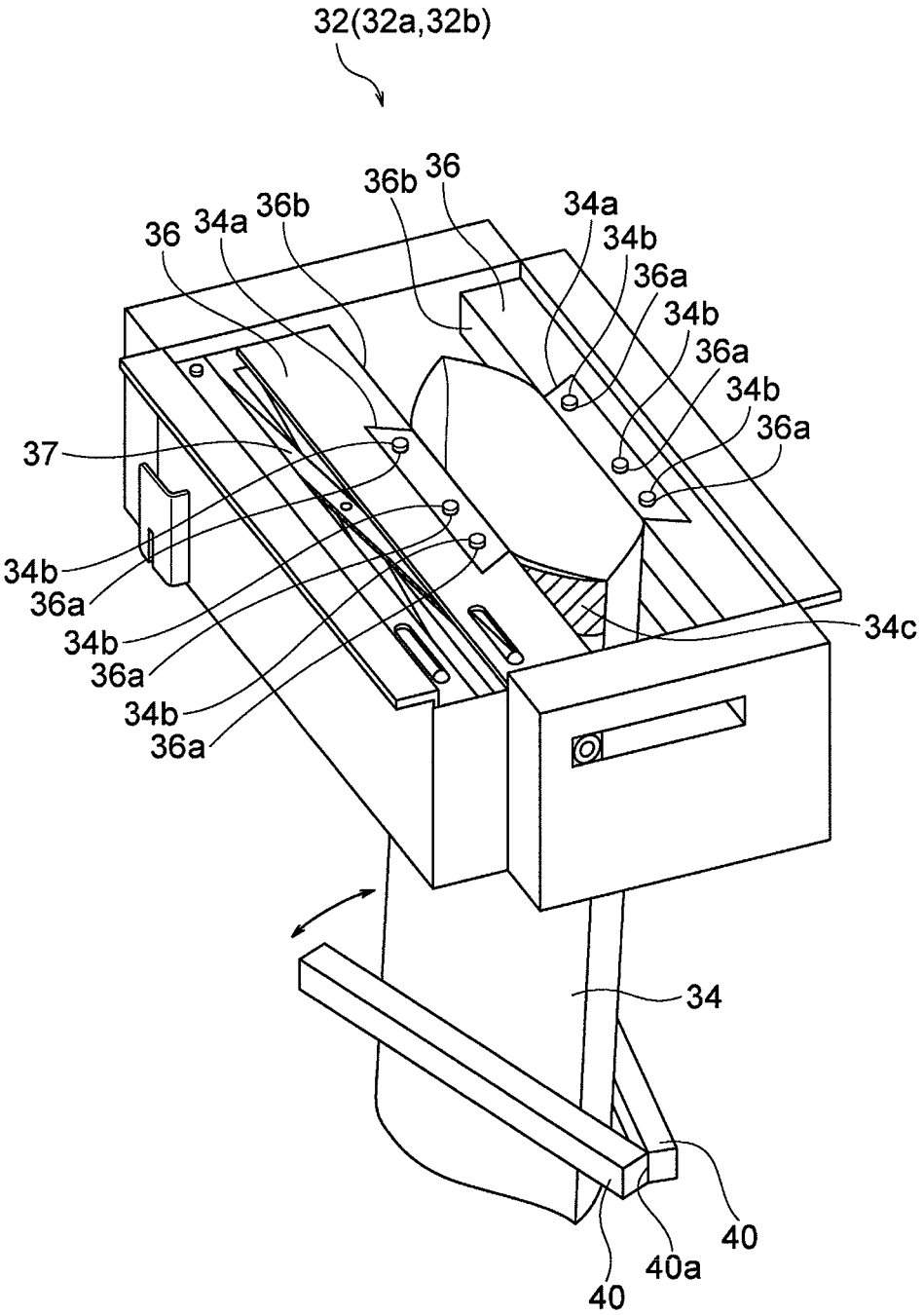
Figure 6:
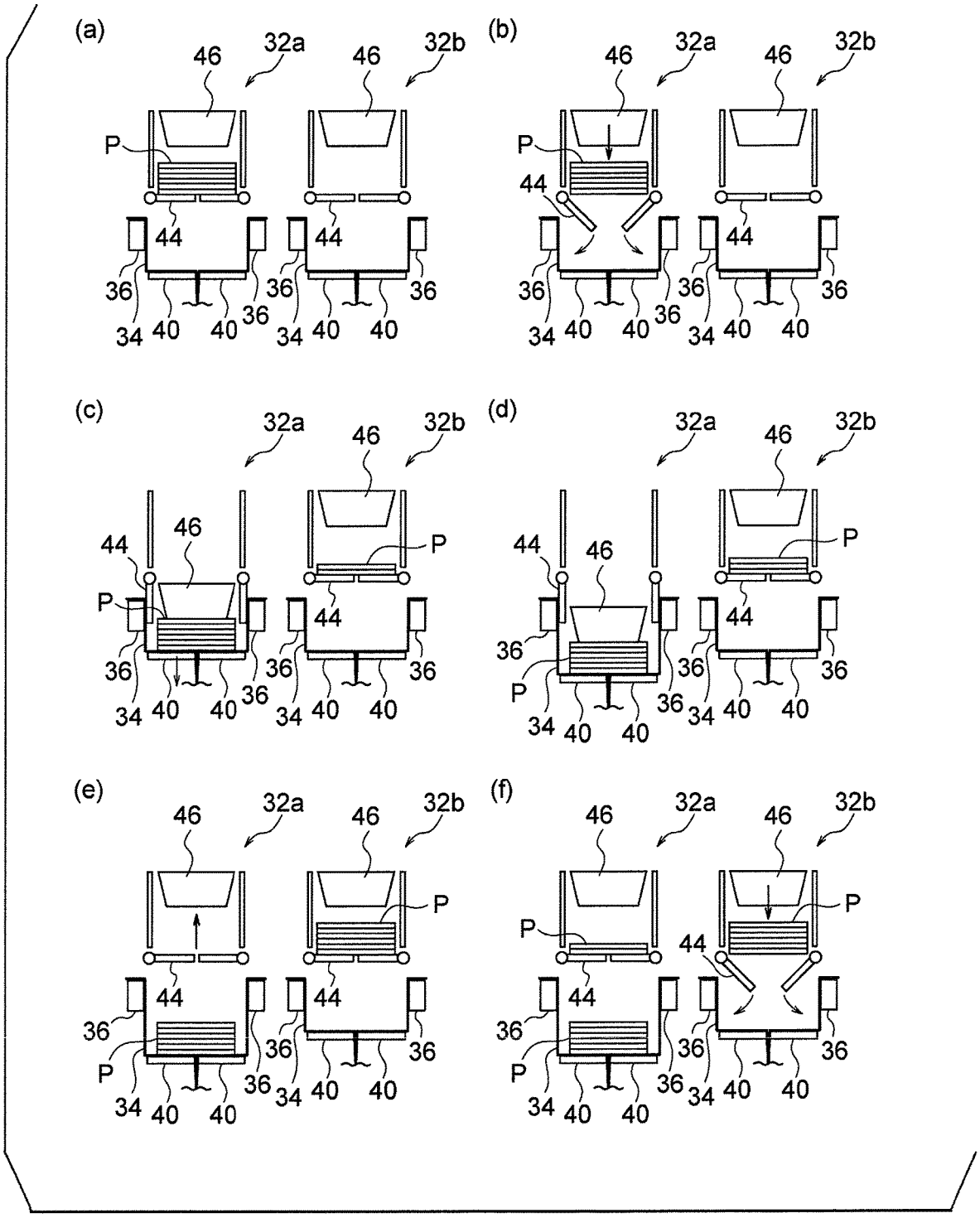
FIG. 6 is a side view schematically showing an operation of storing banknotes in the banknote storage bag by a parallel processing mode in each banknote storage mechanism of the banknote handling machine shown in FIG. 1.
Figure 7:
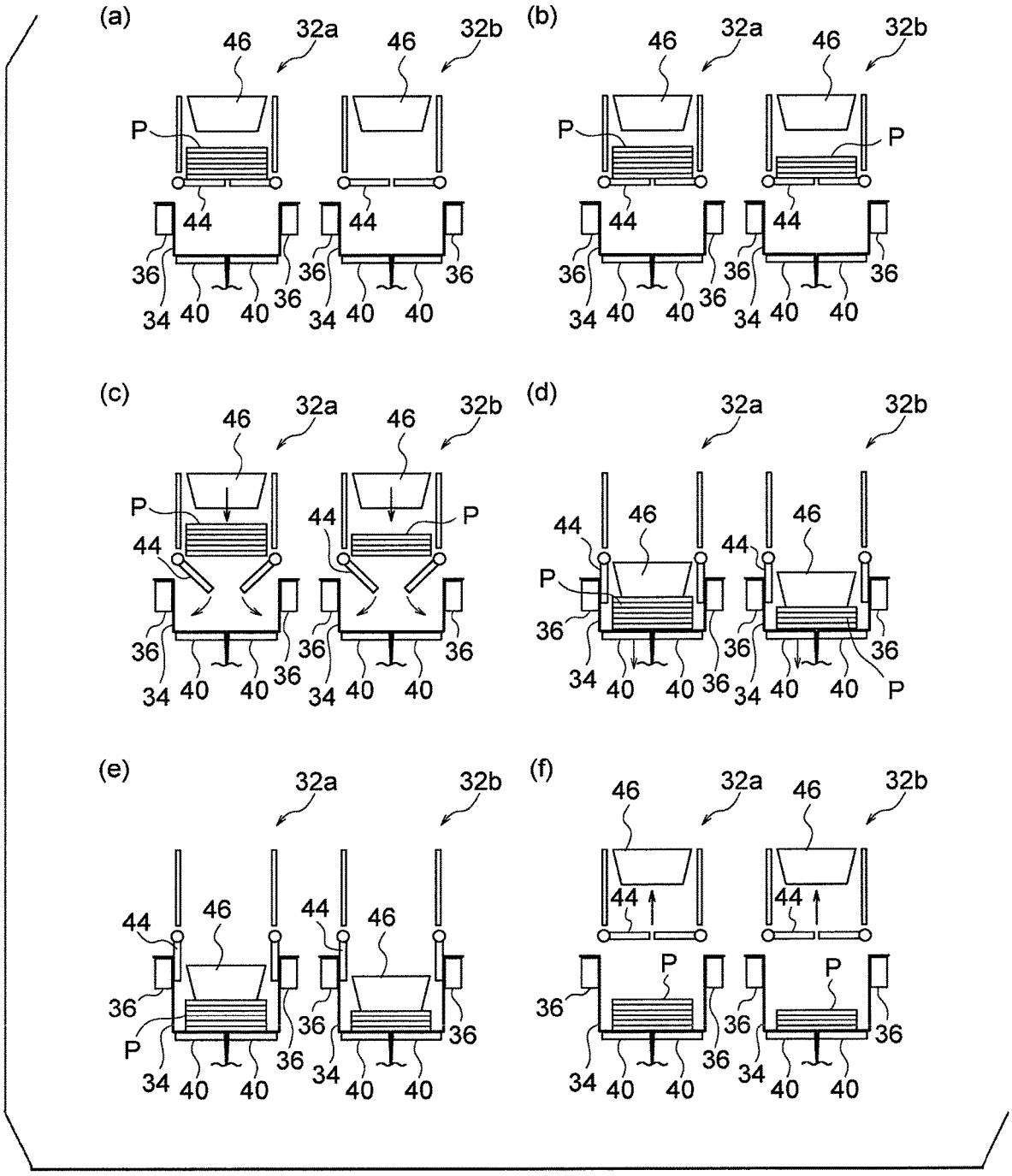
FIG. 7 is a side view schematically showing an operation of storing banknotes in the banknote storage bag by a hold processing mode in each banknote storage mechanism of the banknote handling machine shown in FIG. 1.
Figure 8:
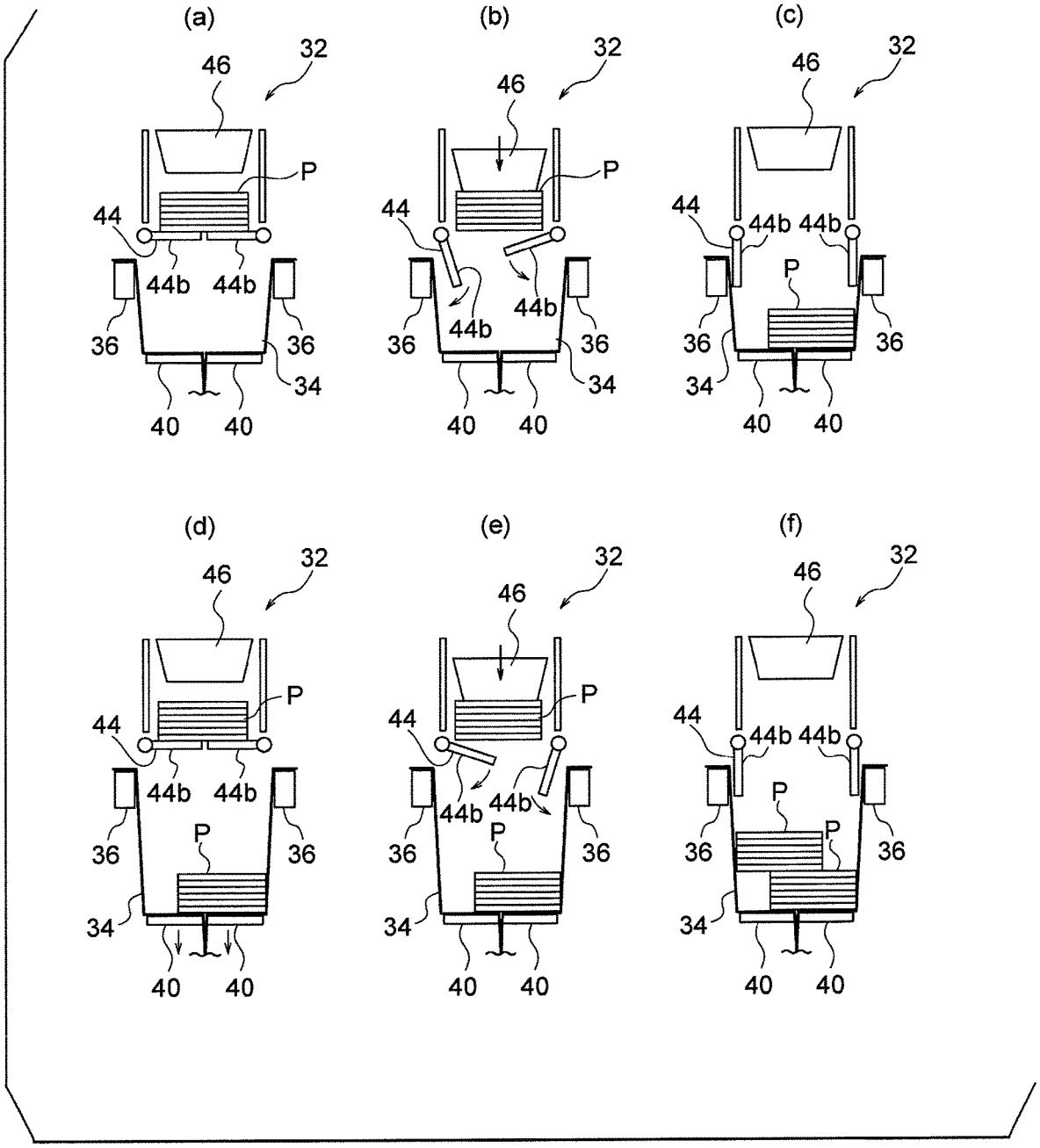
FIG. 8 is a side view schematically showing another example of an operation of storing banknotes in the banknote storage bag in the banknote storage mechanism shown in FIG. 2.

Hereinafter, in an embodiment of the present invention, a case where a banknote handling machine for handling banknotes is used as a sheet handling machine according to the present invention will be described. FIGS. 1 to 9 are diagrams showing a banknote handling machine according to the present embodiment. In FIGS. 6 to 8, a plurality of banknotes in a stacked state is indicated by reference P.

Figure 1:
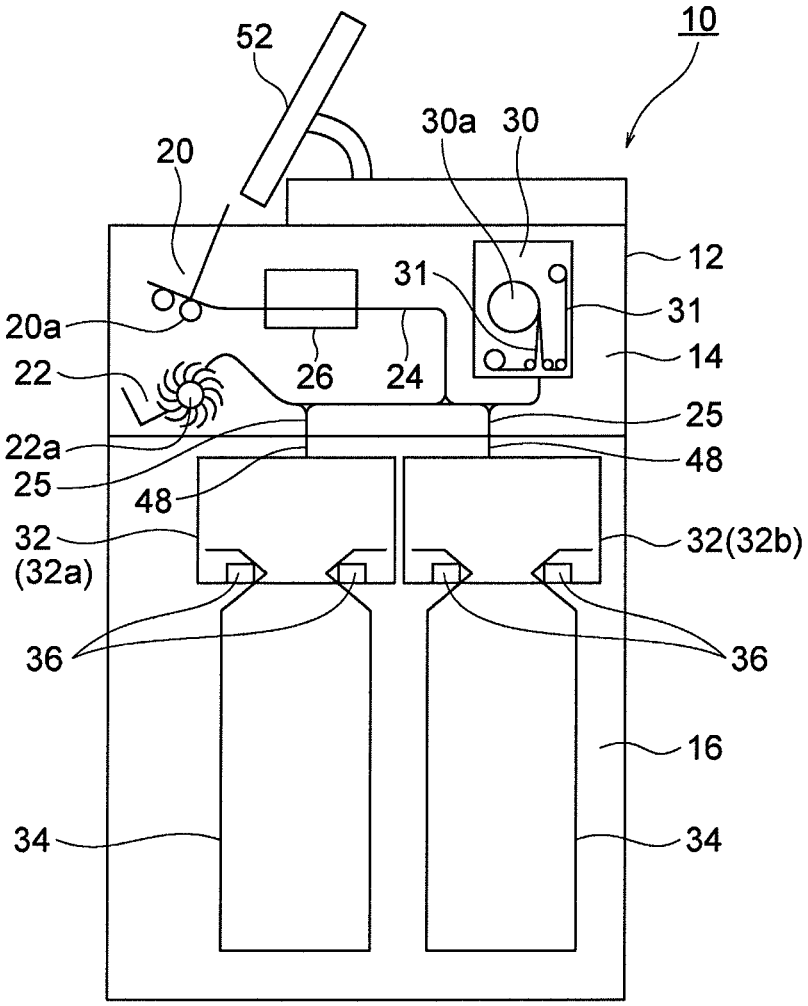
FIG. 1 is a schematic configuration diagram schematically showing an internal configuration of a banknote handling machine according to an embodiment of the present invention.

A banknote handling machine 10 according to the present embodiment is generally installed in a front office area, back office area, or placed in a lobby of a bank or an inside of the bank, and the banknote handling machine 10 can perform various processes such as a deposit processing of the banknotes. As shown in FIG. 1, the banknote handling machine 10 according to the present embodiment has a substantially rectangular parallelepiped housing 12. A left side surface of the housing 12 in FIG. 1 is a front surface of the housing 12 (that is, the surface facing an operator). An upper assembly 14 and a lower assembly 16 are arranged inside the housing 12 such that the upper assembly 14 and the lower assembly 16 can be respectively drawn forward from the front surface of the housing 12 (specifically, to the left in FIG. 1). In the upper assembly 14, an inlet unit 20 such as a hopper for taking in the banknotes from outside into inside the housing 12 is disposed at an upper part of the front surface of the housing 12 (the upper part of the left side surface in FIG. 1). Further, in the upper assembly 14, an outlet 22 for feeding out the banknotes from inside the housing 12 to outside is disposed below the inlet unit 20 in the front surface of the housing 12 (the surface on the left side in FIG. 1).

The inlet unit 20 is provided with a banknote feeding mechanism 20*a* for feeding the banknotes placed on the inlet unit 20 in a stacked manner by the operator one by one into the housing 12. A transporting unit 24 for transporting the banknotes one by one in the housing 12 is disposed in the upper assembly 14 inside the housing 12 of the banknote handling machine 10. The banknote fed out from the inlet unit 20 into inside by the banknote feeding mechanism 20*a* is transported one by one by the transporting unit 24. The transporting unit 24 is provided with a recognition unit 26. Each banknote fed out to the transporting unit 24 by the banknote feeding mechanism 20*a* is recognized by the recognition unit 26 for the denomination, authenticity, front/back, fitness, new/old, transportation state, and the like.

As shown in FIG. 1, the outlet 22 is connected to the transporting unit 24, and the banknote sent from the transporting unit 24 to the outlet 22 is stacked in the outlet 22. The outlet 22 is accessible from outside the housing 12 so that the operator can take out the banknotes stacked in the outlet 22 from the front surface of the housing 12. A stacking wheel 22*a* is disposed at a connection point between the transporting unit 24 and the outlet 22, and the stacking wheel 22*a* is adapted to rotate in a counterclockwise direction in FIG. 1. When the banknote is sent from the transporting unit 24 to the outlet 22, the stacking wheel 22*a* rotates in the counterclockwise direction in FIG. 1 in a state in which the banknote is held between two blades of the stacking wheel 22*a*. Then, the banknote held between the two blades of the stacking wheel 22*a* is stacked in the outlet 22 in an aligned state.

In the upper assembly 14, the transporting unit 24 is provided with a tape-type storage/feeding unit 30. The banknote sent from the transporting unit 24 to the storage/feeding unit 30 is stored in the storage/feeding unit 30 and the banknotes stored in the storage/feeding unit 30 can be fed out one by one to the transporting unit 24. More specifically, the storage/feeding unit 30 is provided with a drum 30*a* rotatable in both forward and reverse directions, and one end of a pair of band-shaped tapes 31 is connected to an outer peripheral surface of the drum 30*a*. When the banknote is sent from the transporting unit 24 to the storage/feeding unit 30, the banknote is wound on the drum 30*a* by each band-shaped tape 31 such that the banknote and each tape 31 are integrally wound on the drum 30*a*. On the other hand, when each tape 31 is rewound from the drum 30*a* by rotating the drum 30*a* in the reverse direction, the banknote wound on the drum 30*a* is discharged from each tape 31 and is fed out to the transporting unit 24.

Figure 2:
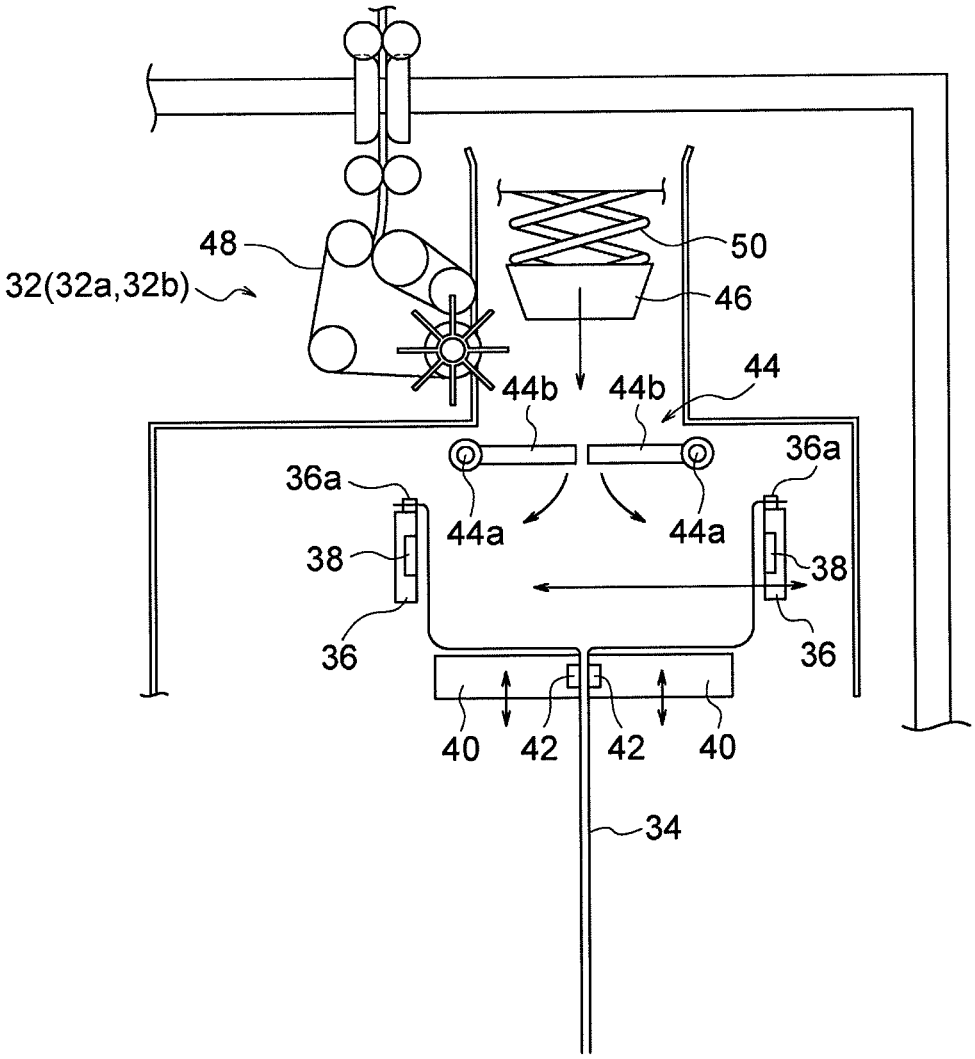
FIG. 2 is a side view showing a detail of a configuration of a banknote storage mechanism in the banknote handling machine shown in FIG. 1.

As shown in FIG. 1, in the present embodiment, two banknote storage mechanisms 32 are disposed in the lower assembly 16 in parallel, and each banknote storage mechanism 32 stores banknotes inside a banknote storage bag 34 with an opening for inserting the banknotes. In the following description, the banknote storage mechanism 32 on the left side of the two banknote storage mechanisms 32 may be indicated by reference number 32*a* and the banknote storage mechanism 32 on the right side may be indicated by the reference number 32*b*. Each banknote storage mechanism 32 is provided with a pair of holding members 36 which space apart from each other and face each other. Two portions of the banknote storage bag 34, facing each other in the vicinity of the opening of the banknote storage bag 34, are held by the pair of holding members 36, respectively. One holding member 36 (For example, the holding member 36 on the left side in FIGS. 1 and 2) is fixed in a fixed position and does not move from the fixed position. In contrast, the other holding member 36 (For example, the holding member 36 on the right side in FIGS. 1 and 2) can move towards the one holding member 36 fixed in the fixed position. In the present embodiment, the pair of holding members 36 functions as a mounting unit to which the banknote storage bag 34 is detachably mounted. As shown in FIG. 2, each holding member 36 is provided with a heating member 38. After a predetermined amount of the banknotes are stored in the banknote storage bag 34 held by the holding members 36 in the banknote storage mechanism 32, before the banknote storage bag 34 is taken out from the banknote storage mechanism 32, the one holding member 36 moves toward the other holding member 36. Then, the two holding members 36 are in contact with each other via the banknote storage bag 34, and the heating members 38 heat the portion near the opening of the banknote storage bag 34. As a result, the opening of the banknote storage bag 34 is sealed by heat. In the banknote storage mechanism 32, instead of moving the one holding members 36 of the pair of holding members 36 towards the other holding member 36, both holding members 36 may be moved to a central position towards each other so that the two holding members 36 touch each other in the central position. Also, when the opening of the banknote storage bag 34 can be sealed by heat with only the heating member 38 of one holding member 36, the heating member 38 may be disposed in only one holding member 36.

A plurality (two in the example shown in FIG. 1) of diverged transporting units 25, corresponding to the banknote storage mechanisms 32 respectively, diverge from the transporting unit 24 in the upper assembly 14. The banknotes transported from the transporting unit 24 to the diverged transporting units 25 are sent from the diverged transporting units 25 to the banknote storage bags 34 mounted to the banknote storage mechanisms 32 respectively, and stored in the banknote storage bags 34.

Figure 3:
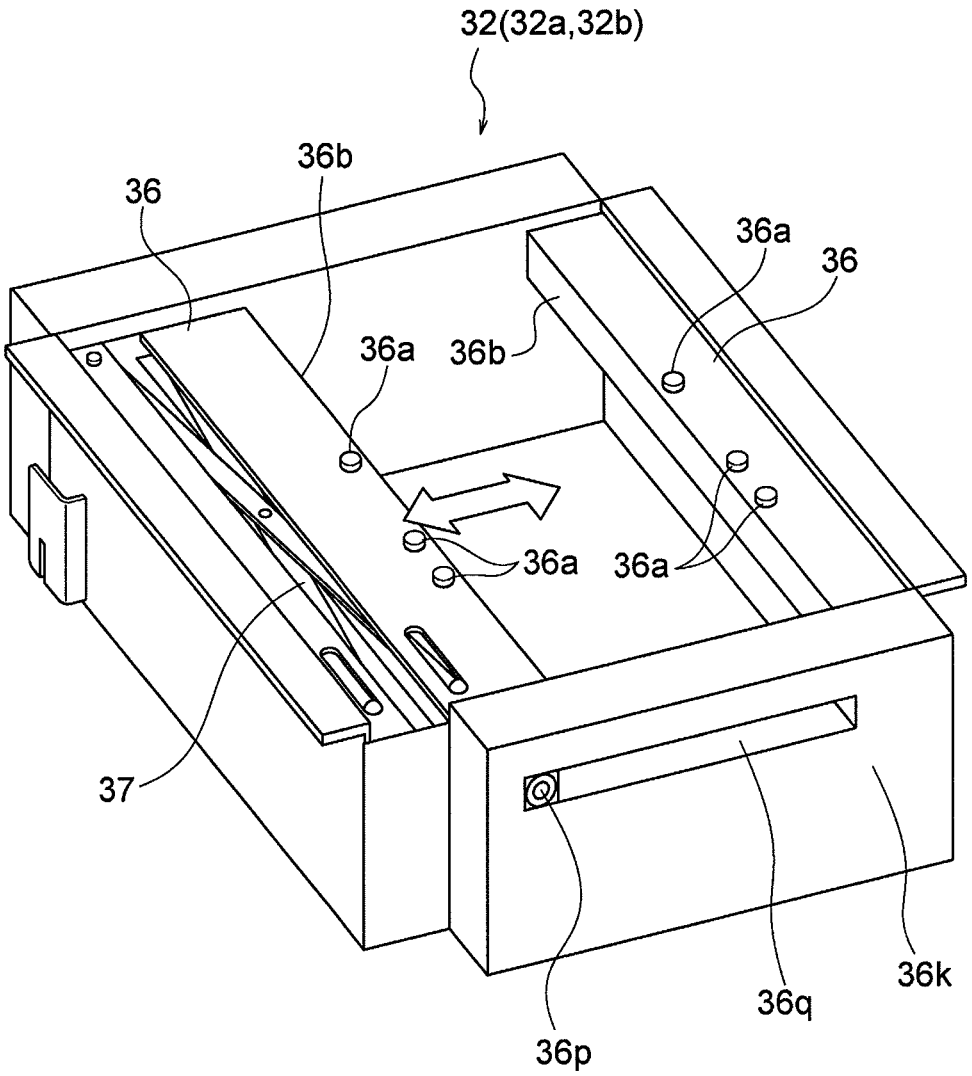
FIG. 3 is a perspective view showing a configuration of a pair of holding members and the like in the banknote storage mechanism shown in FIG. 2.

Next, the configuration of the banknote storage mechanism 32 in the present embodiment will be described in detail with reference to FIGS. 2 to 5. FIG. 2 is a side view showing details of the configuration of the banknote storage mechanism 32, FIG. 3 is a perspective view showing a configuration of a pair of holding members 36 and the like in the banknote storage mechanism 32 shown in FIG. 2, and FIG. 4 is a perspective view showing the configuration of the banknote storage bag 34 held by each holding member 36 in the banknote storage mechanism 32 shown in FIG. 2 and the like. FIG. 5 is a perspective view showing a state in which the banknote storage bag 34 is held by each holding member 36 of the banknote storage mechanism 32 shown in FIG. 2 and the like.

As shown in FIG. 2, the banknote storage mechanism 32 is provided with a banknote sending unit 48, temporary storage unit 44, and stages 40. The banknotes are transported from the diverged transporting unit 25 of the upper assembly 14 to the banknote sending unit 48 located in the lower assembly 16, and then, sent to the banknote storage bag 34 held by the pair of holding members 36. The banknotes sent from the banknote sending unit 48 are temporarily stored on the temporary storage unit 44. The bottom of the banknote storage bag 34 held by the pair of holding members 36 is placed on the stage 40.

As shown in FIG. 2, the banknote sending unit 48 is a combination of roller and belt. The banknotes are transported from the diverged transporting unit 25 of the upper assembly 14 to the banknote sending unit 48 of the lower assembly 16. Then, the banknotes transported to the banknote sending unit 48 are sent onto the temporary storage unit 44 one by one, and then temporarily held on the temporary storage unit 44. The temporary storage unit 44 comprises a pair of left and right temporary storage members 44*b*. Each temporary storage member 44*b* can simultaneously rotate downward (in the direction of the arrow in FIG. 2) around a shaft 44*a* provided at the base end portion. In this way, the banknotes sent from the transporting unit 24 to the temporary storage unit 44 via the diverged transporting unit 25 and the banknote sending unit 48 are stacked on the pair of temporary storage members 44*b*. By rotating each temporary storage member 44*b* downward around each shaft 44*a* at the same time, the banknotes stacked on the pair of temporary storage members 44*b* can be dropped and sent to the banknote storage bag 34.

As shown in FIG. 2, the banknote storage mechanism 32 is provided with the stages 40. At least a part of the banknote storage bag 34 held by the holding members 36 is placed on the upper surfaces of the stages 40. The stages 40 are composed of a pair of a right stage and left stage, and each stage 40 is movable in the vertical direction and the horizontal direction in FIG. 2. More specifically, as shown in FIG. 5, the stages 40 are connected to each other by a hinge 40*a* disposed at an end portion of each stage 40. The two stages 40 can swing in a direction of an arrow in FIG. 5 around the hinge 40*a* along a horizontal plane. When the two stages 40 open, a gap is formed between these stages 40. Then, the banknote storage bag 34 held by the holding members 36 can extend downward from the stages 40 through the gap and a lower part of the banknote storage bag 34 can exist under the stages 40. The stages 40 are driven by a stage driving unit 41 (see FIG. 9) such as an electric actuator. More specifically, the stages 40 are moved in the vertical direction in FIG. 2 by the stage driving unit 41 and opened or closed by moving around the hinge 40*a* along the horizontal plane. Note that the stages 40 connected to each other by the hinge 40*a* are opened or closed by moving around the hinge 40*a* as described above, for the sake of convenience, opening and closing movements of each stage 40 about the hinge 40*a* are indicated by the movement in the lateral direction of each stage 40 in FIGS. 6 to 8.

The stages 40 are provided with heating members 42 respectively. When one stage 40 (for example, the stage 40 on the right side in FIG. 2) is moved toward the other stage 40 (for example, the stage 40 on the left side in FIG. 2) and the stages 40 are in contact with each other via the banknote storage bag 34, the heating members 42 heat a bottom portion of the banknote storage bag 34 storing the banknotes therein, and the bottom portion of the banknote storage bag 34 is sealed by heat. After that, the banknote storage bag 34 is taken out from the banknote storage mechanism 32. In the banknote storage mechanism 32, instead of moving the one stage 40 of the pair of stages 40 towards the other stage 40, both stages 40 may move towards each other and the stages 40 may be in contact with each other. In addition, when the banknote storage bag 34 can be sealed by heat with only the heating member 42 of one stage 40, only one heating member 42 may be provided with one stage 40 of the pair of stages 40.

As shown in FIG. 3, a pantograph 37 is mounted to the left holding member 36 of the pair of left and right holding members 36. When the left holding member 36 is moved by the pantograph 37 toward the right holding member 36, the pair of holding members 36 are in contact with each other. More specifically, a guide pin 36*p* is disposed at an end of the left holding member 36. In addition, a linear long hole 36*q* for guiding the guide pin 36*p* is formed in a frame 36*k* for supporting each holding member 36. Note that the long hole 36*q* is formed so as to extend in a horizontal direction in the frame 36*k*. When the pantograph 37 expands, the guide pin 36*p* disposed at the left holding member 36 is guided along the long hole 36*q*, whereby the left holding member 36 is moved toward the right holding member 36. As a result, a surface 36*b* of the left holding member 36 comes into contact with a surface 36*b* of the right holding member 36.

Further, as shown in FIG. 3, three pin 36*a* are respectively disposed on upper surfaces of the pair of left and right holding members 36. As shown in FIG. 4, a pair of protrusions 34*a* each having three openings 34*b* are disposed at a location near the opening of the banknote storage bag 34 to be held by the holding members 36 (that is, an upper end of the banknote storage bag 34). When the banknote storage bag 34 is held by the holding members 36, each pin 36*a* of each holding member 36 passes through each opening 34*b* formed in each protrusion 34*a* of the banknote storage bag 34. As a result, these protrusions 34*a* are held by the holding members 36.

As shown in FIG. 4, a band-like reinforcing member 34*c* is disposed at a portion near the opening on an outer surface of the banknote storage bag 34. The reinforcing member 34*c* is made of polyethylene terephthalate, which is stronger in stiffness than the banknote storage bag 34. With such a reinforcing member 34*c*, a force to suppress wrinkles near the opening of the banknote storage bag 34 occurs. Note that "rigidness" means that the rigidity against bending is large. As the reinforcing member 34*c*, one with more flexibility than the banknote storage bag 34 may be used. Even in this case, as the banknote storage bag 34 is provided with the reinforcing member 34*c*, which is another member, the stiffness near the opening of the banknote storage bag 34 is strengthened as a whole, and the occurrence of wrinkles near the opening is suppressed.

As shown in FIG. 2, a pusher plate 46 is disposed above the temporary storage members 44*b* of the temporary storage unit 44. The pusher plate 46 is provided with a pantograph 50, and the pusher plate 46 can be moved in the vertical direction by the pantograph 50 expanding and contracting in the vertical direction in FIG. 2. When the banknotes temporarily held on the temporary storage unit 44 are stored in the banknote storage bag 34, by moving the pusher plate 46 downward from a predetermined position shown in FIG. 2, it is possible to push the banknotes held on the temporary storage members 44*b* toward the banknote storage bag 34 in a stacked state. In the present embodiment, the pusher plate 46 functions as a pushing unit which enters the inside of the banknote storage bag 34 held by the pair of holding members 36 and pushes the banknotes stored in the banknote storage bag 34.

Figure 9:
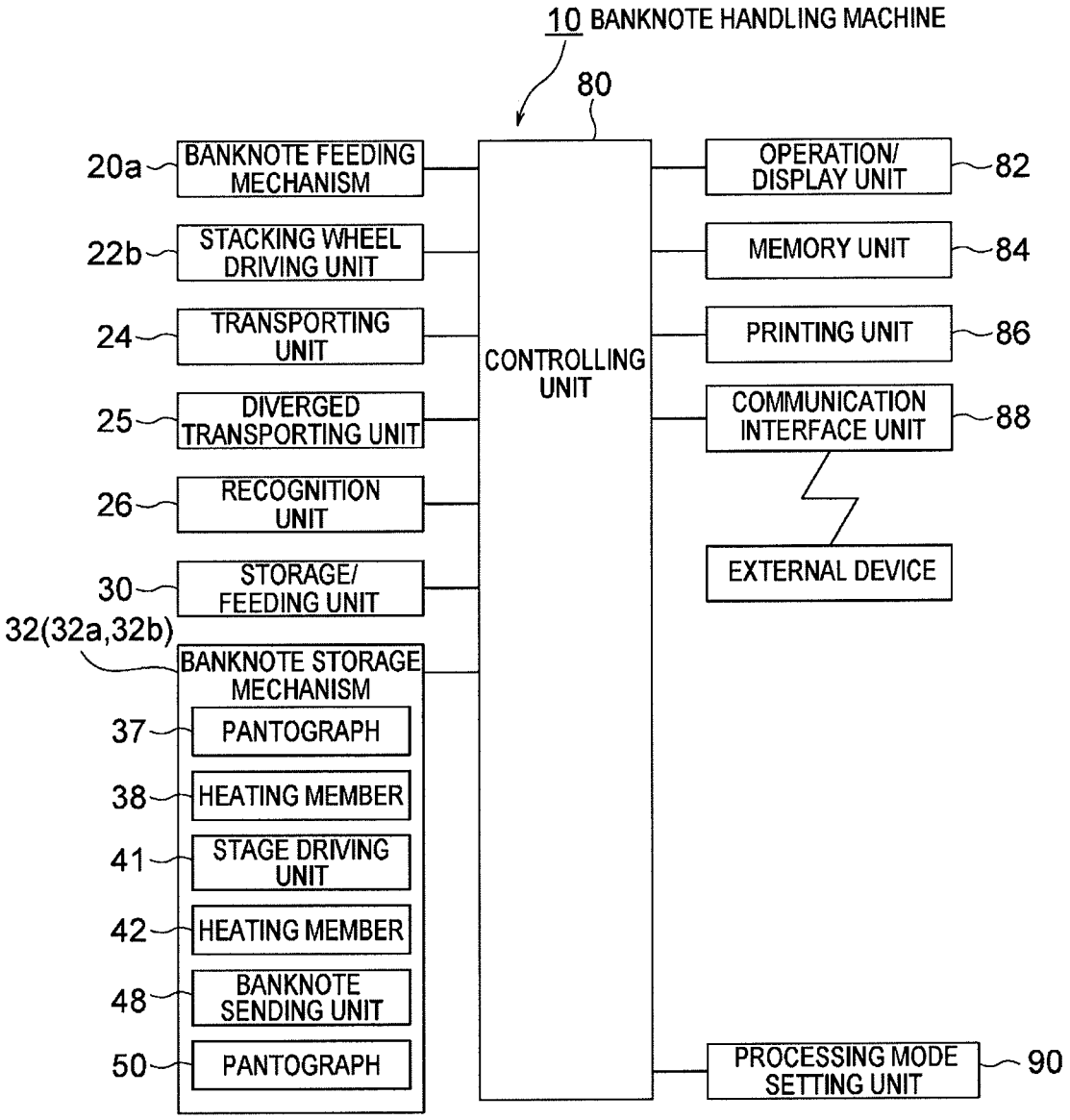

In addition, the banknote handling machine 10 of the present embodiment comprises a controlling unit 80 for controlling components of the banknote handling machine 10. More specifically, as shown in FIG. 9, the controlling unit 80 is connected to the components such as the banknote feeding mechanism 20*a* disposed in the inlet unit 20, a stacking wheel driving unit 22*b* for driving the stacking wheel 22*a* disposed in the outlet 22, the transporting unit 24, the diverged transporting unit 25, the recognition unit 26, the storage/feeding unit 30, the banknote storage mechanism 32 comprising the pantograph 37, the heating member 38, the stage driving unit 41, the heating member 42, the banknote sending unit 48 and the pantograph 50. A signal relating to a recognition result of each banknote by the recognition unit 26 is sent to the controlling unit 80, and the controlling unit 80 controls the operation of the components by sending command signals to the components of the banknote handling machine 10, respectively.

In addition, as shown in FIG. 9, an operation/display unit 82, a memory unit 84, a printing unit 86, and a communication interface unit 88 are respectively connected to the controlling unit 80. As shown in FIG. 1, the operation/display unit 82 is, for example, a touch panel 52 or the like disposed on the upper surface of the housing 12, and information on processing state such as deposit processing of the banknotes in the banknote handling machine 10, information on the inventory amount of the banknotes stored in each banknote storage bag 34 and the like are displayed on the operation/display unit 82. Further, the operator can give various instructions to the controlling unit 80 by operating the operation/display unit 82. The memory unit 84 memorizes processing history such as deposit processing of the banknotes in the banknote handling machine 10 and information on the inventory amount of the banknotes stored in each banknote storage bag 34. The printing unit 86 prints processing history such as deposit processing of the banknotes in the banknote handling machine 10 and information on the inventory amount of the banknotes stored in each banknote storage bag 34 on a receipt or the like. The controlling unit 80 sends and receives signals to and from an external device disposed separately from the banknote handling machine 10 according to the present embodiment (For example, an upper terminal) via the communication interface unit 88. Specifically, the controlling unit 80 can send the information stored in the memory unit 84 to the external device disposed separately from the banknote handling machine 10 via the communication interface unit 88. For example, when security guards of a cash-in-transit company collect banknotes together with the banknote storage bag 34, information on the collected banknotes is transmitted to the computer of the cash-in-transit company by the communication interface unit 88.

As shown in FIG. 9, a processing mode setting unit 90 is connected to the controlling unit 80. The processing mode setting unit 90 sets which processing mode an either a parallel processing mode (described later) or hold processing mode (described later) is to be performed by the controlling unit 80, when the banknotes are stored in the banknote storage bags 34 held by the pair of holding members 36 in each banknote storage mechanism 32. A detail of a function of such a processing mode setting unit 90 will be described later.

Next, an operation of the banknote handling machine 10 having such a configuration will be described. Note that the operation of the banknote handling machine 10 as shown below is performed by the controlling unit 80 controlling each component of the banknote handling machine 10.

First, the operation on which deposit processing of the banknotes is performed in the banknote handling machine 10 will be described. When the operator inputs the banknotes into the inlet unit 20, the operator gives a command of starting deposit processing to the controlling unit 80 through the operation/display unit 82. Then, the banknotes inputted into the inlet unit 20 are fed out one by one into the housing 12 by the banknote feeding mechanism 20*a* and are transported one by one by the transporting unit 24. Each banknote transported by the transporting unit 24 is recognized by the recognition unit 26 for the denomination, authenticity, front/back, fitness, new/old, transportation state, and the like. The banknote recognized as not being a normal banknote by the recognition unit 26, namely a reject banknote, is sent to the outlet 22 by the transporting unit 24 and stacked in the outlet 22. Accordingly, the operator can manually remove the reject banknote stacked in the outlet 22 from the front surface of the housing 12 and reinsert it into the inlet unit 20. On the other hand, the banknote recognized by the recognition unit 26 as being a normal banknote is sent to the storage/feeding unit 30 and temporarily stored in the storage/feeding unit 30. In addition, the number of banknotes for each denomination and/or total amount of the banknotes temporarily stored in the storage/feeding unit 30 is displayed on the operation/display unit 82. When the operator confirms the displayed contents and performs an approval operation of deposit processing, the number of the deposited banknotes for each denomination or the total amount of the deposited banknotes is confirmed, and the banknotes are fed out one by one from the storage/feeding unit 30 to the transporting unit 24. Then, the banknotes are transported from the transporting unit 24 to the diverged transporting unit 25, and then the banknotes are sent from the diverged transporting unit 25 to the banknote storage bag 34 and stored therein.

If the banknote storage bag 34 to which the banknotes recognized by the recognition unit 26 are to be sent is in a full state or a near full state and the banknote storage bag 34 can not store the banknotes any more, the storage/feeding unit 30 may be used as a storage unit of the banknotes until the full state or near full state of the banknote storage bag 34 is resolved. More specifically, the banknotes recognized by the recognition unit 26 are sent to the storage/feeding unit 30 and stored in the storage/feeding unit 30. Then, after the banknote storage bag 34 in the full state or the near full state is taken out from the banknote storage mechanism 32 of the lower assembly 16 by the security guard of the cash-in-transit company or the clerk of the store and then an empty banknote storage bag 34 is mounted to the banknote storage mechanism 32, the banknotes are fed out one by one from the storage/feeding unit 30 to the transporting unit 24 and sent to the banknote storage bag 34 by the transporting unit 24. However, if one banknote storage bag 34 is in a full state or a near full state while the other banknote storage bag 34 is not in a full state or a near full state, when the banknotes recognized by the recognition unit 26 can be sent to the other banknote storage bag 34, the banknotes recognized by the recognition unit 26 are sent to the other banknote storage bag 34.

Next, in each banknote storage mechanism 32 (specifically, the banknote storage mechanism 32*a* on the left side and the banknote storage mechanism 32*b* on the right side in FIG. 1), an operation when storing the banknotes sent from the diverged transporting unit 25 of the upper assembly 14 to the lower assembly 16 in the banknote storage bag 34 held by the pair of holding members 36 will be described.

The banknotes sent from the diverged transporting unit 25 of the upper assembly 14 to the lower assembly 16 are sent by the banknote sending unit 48 onto the pair of temporary storage members 44*b* of the temporary storage unit 44 and are stacked on the temporary storage members 44*b*. Then, after the banknotes are held on the temporary storage unit 44, as each temporary storage member 44*b* simultaneously rotates around the shaft 44*a* provided at the proximal end portion thereof downwardly (that is, in the direction of the arrow in FIG. 2), the banknotes stacked on the temporary storage members 44*b* fall from the temporary storage members 44*b* due to their own weight and are stored in the banknote storage bag 34. In addition, in synchronism with the operation of each temporary storage member 44*b*, the pantograph 50 expands downward, and the pusher plate 46 attached to the lower end of the pantograph 50 also moves downward. As a result, when the banknotes temporarily held on the temporary storage unit 44 are stored in the banknote storage bag 34, the banknote remaining on the temporary storage members 44*b* can be pushed toward the banknote storage bag 34 by the pusher plate 46.

When the banknotes fall from the temporary storage members 44*b* and are stored in the banknote storage bag 34, each stage 40 is moved downward by the stage driving unit 41. By this way, a storage space of the banknotes, sent from the temporary storage unit 44 to the banknote storage bag 34 next time, is formed inside the banknote storage bag 34. More specifically, with the banknotes stored in the banknote storage bag 34 being pressed toward each stage 40 by the pusher plate 46, each stage 40 and the pusher plate 46 move integrally downward in FIG. 2. Thereafter, when the pusher plate 46 reaches the lower end position and a detection sensor (not shown) detects that the pusher plate 46 is located at the lower end position, each stage 40 is stopped. In this manner, when each stage 40 moves downward, the banknotes are pushed toward each stage 40 inside the banknote storage bag 34 by the pusher plate 46 until the pusher plate 46 reaches the lower end position. As a result, since the banknotes stacked in a stacked state inside the banknote storage bag 34 are compressed in the stacking direction, it is possible to prevent the banknotes stored in the banknote storage bag 34 from being disturbed. After each stage 40 is stopped, the pusher plate 46 retreats upward from the banknote storage bag 34.

When each stage 40 moves downward and then is detected by a lower end position detection sensor (not shown), it is determined that the banknotes stored in the banknote storage bag 34 are in a full state or a near full state. In this case, after the pusher plate 46 moves upward from the banknote storage bag 34, the opening of the banknote storage bag 34 is sealed by heat by each heating member 38. In addition, the bottom portion of the banknote storage bag 34 when the banknotes are stored in the banknote storage bag 34 is sealed by heat by each heating member 42. Thereafter, each holding member 36 is moved so that each holding member 36 is separated. In addition, each stage 40 moves so that each stage 40 is separated. Then, by taking out the banknote storage bag 34 from each holding member 36, it is possible to take the banknote storage bag 34 upward from the upper side of each holding member 36 of the banknote storage mechanism 32.

In the banknote handling machine 10 of the present embodiment, as described above, the processing mode setting unit 90 can set which processing mode among the parallel processing mode and hold processing mode is to be performed by the controlling unit 80 when the banknotes are stored in the banknote storage bags 34 held by the pair of holding members 36 in each banknote storage mechanism 32. The parallel processing mode is a processing mode in which a storage operation and a transport operation as described below are performed in parallel. Specifically, in the storage operation, the banknotes held on the temporary storage unit 44 (i.e., the first temporary storage unit 44) in the first banknote storage mechanism 32 (for example, the banknote storage mechanism 32*a* on the left side) among the plurality of banknote storage mechanisms 32 are sent to the banknote storage bag 34. In the transport operation, the banknotes are sent from the transporting unit 24 to the temporary storage unit 44 (i.e., the second temporary storage unit 44) in the second banknote storage mechanism 32 (for example, the banknote storage mechanism 32*b* on the right side) different from the first banknote storage mechanism 32. In detail, the transport operation may be an operation of sending the banknotes from the transporting unit 24 to the temporary storage unit 44 via the diverged transporting unit 25 and the banknote sending unit 48. Further, the hold processing mode is a processing mode in which, when a predetermined condition based on the number of banknotes sent from the transporting unit 24 to the temporary storage unit 44 (i.e., the first temporary storage unit 44) in the first banknote storage mechanism 32 (for example, the banknote storage mechanism 32*a* on the left side) is satisfied, while the banknotes are held on this temporary storage unit 44, the transport operation of sending the banknotes from the transporting unit 24 to the temporary storage unit 44 (specifically, the second temporary storage unit 44) in the second banknote storage mechanism 32 (for example, the banknote storage mechanism 32*b* on the right side) is performed. The predetermined condition may be that the number of banknotes sent to the temporary storage unit 44 has reached a predetermined number set in advance. Alternatively, a sensor for measuring the amount of the banknotes held on the temporary storage unit 44 may be disposed, and the predetermined condition may be that the sensor detects the banknote. The transport operation in the hold processing mode may also be an operation of sending the banknotes from the transporting unit 24 to the temporary storage unit 44 via the diverged transporting unit 25 and the banknote sending unit 48. In the hold processing mode, the storage operation for sending the banknotes held on the temporary storage unit 44 to the banknote storage bag 34 is performed in both the banknote storage mechanisms 32 in parallel, when all the banknotes to be stored in each banknote storage bag 34 are held on the temporary storage unit 44 of each banknote storage mechanism 32, or when each of the temporary storage units 44 of the two banknote storage mechanisms 32 becomes in a full state and it becomes impossible to hold the banknotes any more on each temporary storage unit 44. The parallel processing mode and hold processing mode will be described in detail below with reference to FIGS. 6 and 7, respectively.

First, with reference to FIG. 6, a description will be given of a case where the processing mode setting unit 90 sets that the controlling unit 80 performs processing in the parallel processing mode, when storing the banknotes in the banknote storage bags 34 held by the pair of holding members 36 in each banknote storage mechanism 32. If processing is performed in the parallel processing mode when storing a large number of banknotes in each banknote storage bag 34, first, the banknotes are sent from the transporting unit 24 to the first banknote storage mechanism 32 (specifically, the banknote storage mechanism 32*a* on the left side) and temporarily held on the temporary storage unit 44 (the first temporary storage unit 44) of the banknote storage mechanism 32*a*, as shown in FIG. 6 (*a*). Then, although the predetermined condition (specifically, holding a number of banknotes in which the temporary storage unit 44 is in a full state, or detecting the banknote by a full detection sensor in the temporary storage unit 44) based on the number of banknotes held on the temporary storage units 44 of the banknote storage mechanism 32*a* on the left side is satisfied, if all the banknotes to be stored in the respective banknote storage bags 34 are not held on the temporary storage unit 44, the storage process is started. All the banknotes to be stored in each banknote storage bag 34 are the banknotes confirmed by the approval operation of deposit processing, and have been temporarily stored in the storage/feeding unit 30. When the storage process is started, each temporary storage member 44*b* of the banknote storage mechanism 32*a* on the left side rotates downward around each shaft 44*a*, as shown in FIG. 6 (*b*). In addition, in the banknote storage mechanism 32*a* on the left side, the pantograph 50 expands downward in synchronization with the operation of each temporary storage member 44*b*, and the pusher plate 46 attached to the lower end of the pantograph 50 also moves downward. As a result, as shown in FIG. 6 (*c*), in the banknote storage mechanism 32*a* on the left side, the banknotes temporarily held on the temporary storage member 44*b* are stored in the banknote storage bag 34.

When the banknotes fall from the temporary storage members 44*b* and stored in the banknote storage bag 34 in the banknote storage mechanism 32*a* on the left side, each stage 40 is moved downward by the stage driving unit 41 as shown in FIG. 6 (*d*). Then, the storage space for the banknotes, sent from the temporary storage unit 44 to the banknote storage bag 34 next time, is formed inside the banknote storage bag 34. Thereafter, when the pusher plate 46 reaches the lower end position and the detection sensor (not shown) detects that the pusher plate 46 is located at the lower end position, each stage 40 is stopped. Then, as shown in FIG. 6 (*e*), after each stage 40 is stopped, the pusher plate 46 moves upward from the banknote storage bag 34.

Although the predetermined condition based on the number of banknotes held on the temporary storage unit 44 of the banknote storage mechanism 32*a* on the left side is satisfied, if all the banknotes to be stored in each banknote storage bag 34 have not been held on the temporary storage unit 44 yet, the banknotes are subsequently sent from the transporting unit 24 to the second banknote storage mechanism 32 (specifically, the banknote storage mechanism 32*b* on the right side) and then temporarily held on the temporary storage unit 44 (i.e., the second temporary storage unit 44) of the banknote storage mechanism 32*b*, as shown in FIG. 6 (*c*). Therefore, the transport operation of the banknotes from the transporting unit 24 to each banknote storage mechanism 32*a*, 32*b* is not interrupted.

As shown in FIG. 6 (*e*), in the banknote storage mechanism 32*a* on the left side, as the pushing operation of the banknotes from the temporary storage unit 44 to the banknote storage bag 34 is completed, the pusher plate 46 retreats upward from the banknote storage bag 34, and a series of storage operations is completed. Thereafter, the banknotes are subsequently sent from the transporting unit 24 to the banknote storage mechanism 32*b* on the right side, and the banknotes are temporarily held on the temporary storage unit 44 of the banknote storage mechanism 32*b*. Then, when all the banknotes to be stored in each banknote storage bag 34 are held on the temporary storage unit 44 of each banknote storage mechanism 32, the storage operation of the banknotes held on the temporary storage unit 44 of the banknote storage mechanism 32*b* on the right side is started. Specifically, as shown in FIG. 6 (*f*), each temporary storage member 44*b* of the banknote storage mechanism 32*b* on the right side rotates downward around each shaft 44*a*. In addition, in synchronism with the operation of each temporary storage member 44*b*, the pantograph 50 expands downward, and the pusher plate 46 attached to the lower end of the pantograph 50 also moves downward. As a result, in the banknote storage mechanism 32*b* on the right side, the banknotes temporarily held on the temporary storage member 44*b* are stored in the banknote storage bag 34. Although the predetermined condition based on the number of banknotes held on the temporary storage unit 44 of the banknote storage mechanism 32*b* on the right side is satisfied, if all the banknotes to be stored in each banknote storage bag 34 are not yet held on the temporary storage unit 44 of each banknote storage mechanism 32, the banknotes are subsequently sent from the transporting unit 24 to the banknote storage mechanism 32*a* on the left side, and the banknotes are temporarily held on the temporary storage unit 44 of the banknote storage mechanism 32*a*.

In this way, in the parallel processing mode, the banknotes are alternately sent from the transporting unit 24 to each banknote storage mechanism 32*a*, 32*b*. In addition, the storage operation of sending the banknotes held on the temporary storage unit 44 to the banknote storage bag 34 in a certain banknote storage mechanism 32 (for example, the banknote storage mechanism 32*a* on the left side), and the transport operation of sending the banknotes from the transporting unit 24 to the temporary storage unit 44 via the diverged transporting unit 25 and the banknote sending unit 48 in another banknote storage mechanism 32 (for example, the banknote storage mechanism 32*b* on the right side) are performed in parallel. According to the parallel processing mode, even if the temporary storage unit 44 becomes in a full state in each banknote storage mechanism 32*a*, 32*b*, since the transport operation of the banknotes from the transporting unit 24 to each banknote storage mechanism 32*a*, 32*b* is not interrupted, it is possible to shorten the time for storing the banknotes in each banknote storage bag 34.

When the parallel processing mode is performed, the banknotes are sent from the transporting unit 24 to the temporary storage unit 44 of each banknote storage mechanism 32 such that the banknotes of a plurality of denominations are stored in a mixed state in each banknote storage bag 34. As another example, the banknotes may be sent from the transporting unit 24 to the temporary storage unit 44 of each banknote storage mechanism 32 such that only the banknotes of a specific denomination (for example, one thousand yen) are stored in each banknote storage bag 34. In this case, the banknotes other than the specific denomination are sent from the transporting unit 24 to the outlet 22 or storage/feeding unit 30. In addition, if three or more banknote storage mechanisms 32 are disposed, parallel processing mode can be performed by using two or more banknote storage mechanisms 32 among three or more banknote storage mechanisms 32.

Next, with reference to FIG. 7, a description will be given of a case where the processing mode setting unit 90 sets that the controlling unit 80 performs processing in the hold processing mode, when storing the banknotes in the banknote storage bags 34 held by the pair of holding members 36 in each banknote storage mechanism 32. In the case where the hold processing mode is performed when a large number of banknotes are stored in each banknote storage bag 34, first, as shown in FIG. 7 (*a*), the banknotes are sent from the transporting unit 24 to the first banknote storage mechanism 32 (specifically, the banknote storage mechanism 32*a* on the left side), and then temporarily held on the temporary storage unit 44 (i.e., the first temporary storage unit 44) of the banknote storage mechanism 32*a*. Although the predetermined condition based on the number of banknotes held on the temporary storage unit 44 of the banknote storage mechanism 32*a* on the left side is satisfied, when all the banknotes to be stored in each banknote storage bag 34 are not held on the temporary storage unit 44, the banknote are subsequently sent from the transporting unit 24 to the second banknote storage mechanism 32 (specifically, the banknote storage mechanism 32*b* on the right side) and then temporarily held on the temporary storage unit 44 (i.e., the second temporary storage unit 44) of the banknote storage mechanism 32*b*, as shown in FIG. 7 (*b*). It should be noted that, while the banknotes are being sent from the transporting unit 24 to the banknote storage mechanism 32*b* on the right side, the storage operation is not performed in the banknote storage mechanism 32*a* on the left side. More specifically, each temporary storage member 44*b* does not rotate downward around each shaft 44*a*, and the banknotes are kept stacked on the temporary storage members 44*b*.

When all the banknotes to be stored in each banknote storage bag 34 are held on the temporary storage units 44 of the two banknote storage mechanisms 32*a*, 32*b*, or when a predetermined condition based on the number of banknotes held on the temporary storage unit 44 of the banknote storage mechanism 32*b* on the right side is satisfied, the storing process is simultaneously started in each of the two banknote storage mechanisms 32*a*, 32*b*, as shown in FIG. 7 (*c*). Specifically, each temporary storage member 44*b* rotates downward around each shaft 44*a*. In addition, in synchronism with the operation of each temporary storage member 44*b*, the pantograph 50 expands downward, and the pusher plate 46 attached to the lower end of the pantograph 50 also moves downward. As a result, as shown in FIG. 7 (*d*), in each of the two banknote storage mechanisms 32*a*, 32*b*, the banknotes temporarily held on the temporary storage members 44*b* are stored in the banknote storage bag 34.

When the banknotes fall from the temporary storage members 44*b* in each of the two banknote storage mechanisms 32*a*, 32*b* and are stored in the banknote storage bags 34, each stage 40 is moved downward by the stage driving unit 41, as shown in FIG. 7 (*e*). In this way, the storage space for the banknotes, sent from the temporary storage unit 44 to the banknote storage bag 34 next time, is formed inside the banknote storage bag 34. Thereafter, when the pusher plate 46 reaches the lower end position and the detection sensor (not shown) detects that the pusher plate 46 is located at the lower end position, each stage 40 is stopped. Then, in each of the two banknote storage mechanisms 32*a*, 32*b*, after each stage 40 is stopped, the pusher plate 46 retreats upward from the banknote storage bag 34 as shown in FIG. 7 (*f*). Thereafter, if the banknotes to be stored in the banknote storage bag 34 still exist, the banknotes are again sent from the transporting unit 24 to the banknote storage mechanism 32*a* on the left side, and the banknotes are temporarily held on the temporary storage unit 44 of the banknote storage mechanism 32*a*.

In this manner, in the hold processing mode, if the number of banknotes sent from the transporting unit 24 to the temporary storage unit 44 (i.e., the first temporary storage unit 44) in the first banknote storage mechanism 32 (for example, the banknote storage mechanism 32*a* on the left side) reaches the predetermined number, the state in which the banknotes are held on the temporary storage unit 44 is maintained. In this state, in the second banknote storage mechanism 32 (for example, the banknote storage mechanism 32*b* on the right side), the transport operation for sending the banknotes from the transporting unit 24 to the temporary storage unit 44 (i.e., the second temporary storage unit 44) is performed. In addition, when all the banknotes to be stored in each banknote storage bag 34 are held on the temporary storage units 44 of the two banknote storage mechanisms 32, or when the temporary storage unit 44 of each banknote storage mechanism 32 becomes in a full state and it becomes impossible to hold the banknotes any more on the temporary storage unit 44, the storing process is performed to send the banknotes held on the temporary storage unit 44 to the banknote storage bag 34 in both the banknote storage mechanisms 32. For example, in the deposit processing, when all the banknotes to be stored in each banknote storage bag 34 are held on the temporary storage unit 44 of each banknote storage mechanism 32, if an error occurs during the process of holding the banknotes on the temporary storage unit 44 and it becomes necessary to take out the deposited banknotes to the outside, it is possible to take out only the deposited banknotes to the outside without being confused with other banknotes. If three or more banknote storage mechanisms 32 are disposed, it is possible to perform the hold processing mode by using two or more banknote storage mechanisms 32 among three or more banknote storage mechanisms 32.

In the banknote handling machine 10 of the present embodiment, it is set by the processing mode setting unit 90 that the controlling unit 80 performs processing in the hold processing mode at a normal case (default). When the operator selects to perform processing in the parallel processing mode on the setting screen or the like displayed on the operation/display unit 82, it is set by the processing mode setting unit 90 that the controlling unit 80 performs the processing in the parallel processing mode. As another example, when the banknotes are stored in each banknote storage bag 34, it may be set by the processing mode setting unit 90 that the controlling unit 80 performs the processing in the parallel processing mode, if information on the number of banknotes to be stored in each banknote storage bag 34 is input to the controlling unit 80 by the operation/display unit 82 or the like and the number of the inputted number of banknotes is larger than the sum of the maximum number of banknotes that can be held on the temporary storage unit 44 in each of the two banknote storage mechanisms 32*a*, 32*b*. More specifically, if the number of banknotes to be stored in each banknote storage bag 34 is smaller than the sum of the maximum number of banknotes that can be held on the temporary storage unit 44 in each of the two banknote storage mechanisms 32*a*, 32*b*, even if processing is performed in either of the parallel processing mode and the hold processing mode, the transport operation of the banknotes from the transporting unit 24 to each banknote storage mechanism 32*a*, 32*b* is not interrupted. Therefore, the time for storing the banknotes in each banknote storage bag 34 does not change greatly. So, it is preferable to perform processing in the hold processing mode so as to be able to take out the banknotes in the middle of storage processing at the time of error. On the other hand, if the number of banknotes to be stored in each banknote storage bag 34 is larger than the sum of the maximum number of banknotes that can be held on the temporary storage unit 44 in each of the two banknote storage mechanisms 32*a*, 32*b*, the transport operation of the banknotes from the transporting unit 24 to each banknote storage mechanism 32*a*, 32*b* is not interrupted in the parallel processing mode, while it is necessary to interrupt the transport operation of the banknotes from the transporting unit 24 to each banknote storage mechanism 32*a*, 32*b* in the hold processing mode. Therefore, it is preferable to shorten the time for storing the banknotes in each banknote storage bag 34 by performing the processing in the parallel processing mode.

According to the banknote handling machine 10 of the present embodiment having such a configuration and the banknote handling method performed by the banknote handling machine 10, in the parallel processing mode, the storage operation for sending the banknotes held on the first temporary storage unit 44 (for example, the temporary storage unit 44 of the banknote storage mechanism 32*a* on the left side) to the banknote storage bag 34 (a storage member) when the predetermined condition based on the number of banknotes sent from the transporting unit 24 to the first temporary storage unit 44 is satisfied, and the transport operation for transporting the banknotes from the transporting unit 24 to the second temporary storage unit 44 (for example, the temporary storage unit 44 of the banknote storage mechanism 32*b* on the right side) are performed in parallel. Therefore, it is possible to shorten the time for storing the banknotes in the banknote storage bag 34.

More specifically, in the conventional banknote handling machine, in the case where the number of banknotes to be stored in the banknote storage bag is large in a single storage process, when an operation of sending the banknotes from the transporting unit to the temporary storage unit is performed, if the temporary storage unit becomes in a full state or near full state, the operation of sending the banknotes from the transporting unit to the temporary storage unit is interrupted. Then, the banknotes temporarily held on the temporary storage unit are sent to the banknote storage bag collectively, and the banknotes are stored in this banknote storage bag. This causes the temporary storage unit to be in an empty state, and thereafter the operation of sending the banknotes from the transporting unit to the temporary storage unit is restarted. However, in such a banknote handling method performed by the conventional banknote handling machine, when the banknotes held on the temporary storage unit are stored in the banknote storage bag, it is impossible to send the banknotes from the transporting unit to the temporary storage unit, so there is a problem that the time for storing the banknotes in the banknote storage bag becomes long. On the other hand, in the banknote handling machine 10 and the banknote handling method according to the present embodiment, when the number of banknotes held on a certain temporary storage unit 44 reaches a predetermined number set in advance, while the storage operation for sending the banknotes held on this temporary storage unit 44 to the banknote storage bag 34 is performed, the transport operation is performed to send the banknotes from the transporting unit 24 to another temporary storage unit 44. Therefore, the operation of sending the banknotes from the transporting unit 24 to each temporary storage unit 44 is not interrupted. This makes it possible to shorten the time for storing the banknotes in the banknote storage bag 34.

In the banknote handling machine 10 of the present embodiment, as described above, the controlling unit 80 controls the transporting unit 24 such that the banknotes are sent from the transporting unit 24 to each temporary storage unit 44 so that the banknotes of a plurality of denominations are respectively stored in a mixed state in the plurality of banknote storage bags 34. In addition, as the mounting unit to which the banknote storage bag 34 is detachably mounted, the pair of holding members 36 for holding the positions of the banknote storage bag 34 near the opening thereof is used. Further, the pusher plate 46 (pushing unit) can move in the direction to enter the inside of the banknote storage bag 34 to push the banknotes stored in the banknote storage bag 34 (more specifically, substantially vertical direction). The pair of stages 40 is used as a placement unit on which at least a part of the banknote storage bag 34 held by each holding member 36 is placed. The above storage operation includes the operation of moving each stage 40 in the above direction (that is, in the substantially vertical direction) (see an arrow in FIG. 6 (*c*)). Further, the pusher plate 46 is used as the pushing unit for entering the inside of the banknote storage bag 34 held by each holding member 36 and pushing the banknotes stored in the banknote storage bag 34. The above storage operation includes the operation in which the pusher plate 46 enters the inside of the banknote storage bag 34 to push the banknotes stored in the banknote storage bag 34 (see FIGS. 6 (*c*) and (*d*)). The above storage operation may include the operation of returning the pusher plate 46 to a predetermined position outside the banknote storage bag 34 after the pusher plate 46 completes the pushing operation (see FIG. 6 (*e*)). In addition, each temporary storage unit 44 is arranged above the banknote storage bag 34 held by the corresponding holding members 36. Further, each temporary storage unit 44 includes the temporary storage members 44*b* which are respectively rotatable around the shaft 44*a*, and the banknotes sent from the transporting unit 24 to the temporary storage unit 44 are stacked on the temporary storage members 44*b*. Then, the above storage operation includes the operation in which each temporary storage member 44*b* rotates downward around each shaft 44*a* to drop the banknotes stacked on the temporary storage members 44*b* to send the banknotes in the banknote storage bag 34 held by each holding member 36.

In the banknote handling machine 10 of the present embodiment, as described above, the controlling unit 80 controls the transporting unit 24 and the temporary storage unit 44 to perform the parallel processing mode when a predetermined condition based on the number of banknotes sent from the transporting unit 24 to the first temporary storage unit 44 is satisfied and all the banknotes to be stored in the banknote storage bag 34 are not yet held on the first temporary storage unit 44. Note that in parallel processing mode, the storage operation for sending the banknotes held on the first temporary storage unit 44 to the banknote storage bag 34 and the transport operation for transporting the banknotes from the transporting unit 24 to the second temporary storage unit 44 different from the first temporary storage unit 44 are performed in parallel. The controlling unit 80 can also perform the hold processing mode (specifically, the above-described hold processing mode) to perform the transport operation of sending the banknotes from the transporting unit 24 to the second temporary storage unit 44 while holding the banknotes on the first temporary storage unit 44, when the number of banknotes sent from the transporting unit 24 to the first temporary storage unit 44 reaches a predetermined number set in advance. Also, the processing mode setting unit 90 is disposed as a setting unit for setting which of the parallel processing mode and hold processing mode is performed by the controlling unit 80.

Note that the banknote handling machine 10 and the banknote handling method according to the present embodiment are not limited to the above-described aspects, and various modifications can be made.

For example, in the above description, it is described that, in each temporary storage unit 44, the pair of temporary storage members 44*b* rotate simultaneously downward around each shaft 44*a*, thereby the banknotes stacked on the pair of temporary storage members 44*b* fall and sent to banknote storage bag 34. However, the banknote handling machine 10 according to the present embodiment is not limited to such an aspect. As another aspect of the banknote handling machine 10 according to the present embodiment, in each temporary storage unit 44, the pair of right and left temporary storage members 44*b* may rotate downward at different timings. Such an aspect will be described below with reference to FIG. 8 (*a*) to (*f*).

When the banknotes are stored in the banknote storage bag 34 held by the pair of holding members 36 in the banknote storage mechanism 32, the banknotes sent from the transporting unit 24 to the banknote storage mechanism 32 are temporarily held on the temporary storage unit 44, as shown in FIG. 8 (*a*). Then, when all the banknotes to be stored in the banknote storage bag 34 are held on the temporary storage unit 44, or when the number of banknotes held on the temporary storage unit 44 reaches a predetermined number set in advance (specifically, the number of banknotes in which the temporary storage unit 44 becomes in a full state), each temporary storage member 44*b* of the temporary storage unit 44 rotates downward around each shaft 44*a* as shown in FIG. 8 (*b*). At this time, the temporary storage member 44*b* on the left side starts to rotate downward, and after a predetermined time has elapsed, the temporary storage member 44*b* on the right side starts to rotate downward. In this case, since the timing at which the temporary storage member 44*b* on the right side starts to rotate downward is delayed, the banknotes are stacked in a relatively right region inside the banknote storage bag 34 as shown in FIG. 8 (*c*). When the storage operation of the banknotes from the temporary storage unit 44 to the banknote storage bag 34 is completed, the banknotes are again sent from the transporting unit 24 to the banknote storage mechanism 32 and temporarily held on the temporary storage unit 44 as shown in FIG. 8 (*d*). Then, when all the banknotes to be stored in the banknote storage bag 34 are held on the temporary storage unit 44, or when the number of banknotes held on the temporary storage unit 44 reaches a predetermined number set in advance (specifically, the number of banknotes in which the temporary storage unit 44 becomes in a full state), the temporary storage member 44*b* on the right side starts to rotate downward, and after a predetermined time has elapsed, the temporary storage member 44*b* on the left side starts to rotate downward as shown in FIG. 8 (*e*). In this case, since the timing at which the temporary storage member 44*b* on the left side starts to rotate downward is delayed, the banknotes are stacked in a relatively left region inside the banknote storage bag 34 as shown in FIG. 8 (*f*).

In this manner, when the pair of temporary storage members 44*b* rotate downward, since the timing at which each temporary storage member 44*b* starts to rotate downward is alternately changed on the left and right, the positions where the banknotes are stacked inside the banknote storage bag 34 are alternately changed on the left and right. In this case, the height of the banknotes stored in the banknote storage bag 34 becomes smaller as compared with the case where the banknotes of the same number are stacked at the same position inside the banknote storage bag 34. Therefore, more banknotes can be stored in the banknote storage bag 34.

In a banknote handling machine according to another modification, a tubular banknote storage bag provided with openings at an upper part and a lower part respectively may be supported by a support unit, and the banknotes are stored in this banknote storage bag supported by the support unit. Even in this case, the principle of the present invention can be applied to the banknote handling machine according to the modification described above.

In still another aspect of the present embodiment, instead of sealing the opening of the storage bag by heat by the heating member, the opening of the storage bag may be sealed by adhering the opening with an adhesive. Specifically, as a banknote storage bag in which the banknotes are stored, one in which the adhesive is disposed at the opening on the inner surface of the banknote storage bag may be used. In this case, the opening of the banknote storage bag can be sealed by adhering the opening of the banknote storage bag with the adhesive. Even in this case, the principle of the present invention can be applied to the banknote handling machine according to the modification described above.

In yet another aspect of the present embodiment, the heating member for sealing the opening of the banknote storage bag by heat may be a member different from each holding member for holding the portion of the banknote storage bag near the opening of the banknote storage bag. In addition, a heating member that seals the bottom portion of the banknote storage bag when storing the banknotes in the banknote storage bag by heat may be a member different from each stage. Also, the bottom portion of the banknote storage bag when the banknotes are stored in the banknote storage bag may not be sealed. In this case, no heating member is disposed at each stage or the like.

In the banknote handling machine according to the present invention, instead of using the banknote storage bag as a storage member for storing the banknotes, a banknote storage cassette may be used. In this case, an accommodating space is formed in each banknote storage mechanism to accommodate the banknote storage cassette instead of disposing each holding member as described above. That is, the accommodating space in which the banknote storage cassette is accommodated is formed in a mounting unit to which the banknote storage cassette for storing the banknotes is detachably mounted. Even in this case, the principle of the present invention can be applied to the banknote handling machine according to the modification described above.

Also, the operation/display unit 82 may be used as the processing mode setting unit 90, or another device communicating with the banknote handling machine 10 may be used as the processing mode setting unit 90.

In yet another aspect of the present embodiment, a pair of holding members 36 may be disposed spaced apart in the vertical direction, and the banknote storage bag 34 may be held so that the opening of the banknote storage bag 34 faces in the lateral direction. At this time, the temporary storage unit 44 is disposed beside the pair of holding members 36, and holds the banknotes in a standing state. Also, the pusher plate 46 is disposed beside the temporary storage member 44*b* and moves in the lateral direction. As the pusher plate 46 moves in the lateral direction, the banknotes held by the temporary storage unit 44 are pushed toward inside the banknote storage bag 34 in a stacked state. In addition, a pair of upper and lower stages 40 is disposed. Each stage 40 is moved laterally by the stage driving unit 41, and a storage space for the banknotes, to be sent from the temporary storage unit 44 to the banknote storage bag 34 next time, is formed inside the banknote storage bag 34.

In the above described embodiment, the approval operation of deposit processing is performed on the banknotes temporarily stored in the storage/feeding unit 30 and the number of the deposited banknotes for each denomination or total amount of the deposited banknotes is confirmed. However, the storage/feeding unit 30 may not be used. Specifically, the deposited banknote recognized as the normal banknote by the recognition unit 26 may be directly sent to the temporary storage unit 44 of the banknote storage mechanism 32 without being sent to the storage/feeding unit 30.

In this case, in the case where the parallel processing mode is performed, when a predetermined condition based on the number of banknotes sent from the transporting unit 24 to the first temporary storage unit 44 is satisfied and all the banknotes to be stored in the banknote storage bag 34 have not been held on the first temporary storage unit 44 yet, the controlling unit 80 performs the storage operation for sending the banknotes held on the temporary storage unit 44 to the banknote storage bag 34 and the transport operation for sending the banknotes from the transporting unit 24 to the second temporary storage unit 44 different from the first temporary storage unit 44 in parallel. In this case, if the deposited banknotes are not left in the inlet unit 20 and all the banknotes taken into the housing 12 are held on the first temporary storage unit 44, it is determined that all the banknotes to be stored in the banknote storage bag 34 are held on the first temporary storage unit 44. On the other hand, if at least one banknote remains in the inlet unit 20 or if there is a banknote that was taken into the housing 12 but is not held on the first temporary storage unit 44, it is determined that all the banknotes to be stored in the banknote storage bag 34 are not yet held on the first temporary storage unit 44. Next, when it is determined that all the banknotes to be stored in the banknote storage bag 34 are held on the second temporary storage unit 44, the controlling unit 80 controls the operation/display unit 82 to display a message requesting the operator to input a deposit confirmation command. Thereafter, when the operator inputs the deposit confirmation command to the controlling unit 80 through the operation/display unit 82, the storage operation is performed to send the banknotes held on the second temporary storage unit 44 to the banknote storage bag 34, thereby completing the deposit processing.

In addition, in the case where the hold processing mode is performed, when a predetermined condition based on the number of banknotes sent from the transporting unit 24 to the first temporary storage unit 44 is satisfied and all the banknotes to be stored in the banknote storage bag 34 have not been held on the first temporary storage unit 44 yet, the controlling unit 80 performs the transport operation of transporting the banknotes from the transporting unit 24 to the second temporary storage unit 44 different from the first temporary storage unit 44, while holding the banknotes on the first temporary storage unit 44. Next, when it is determined that all the banknotes to be stored in the banknote storage bag 34 are held on the second temporary storage unit 44, the controlling unit 80 controls the operation/display unit 82 to display a message requesting the operator to input a deposit confirmation command. Thereafter, when the operator inputs the deposit confirmation command to the controlling unit 80 through the operation/display unit 82, the storage operation is performed to send the banknotes held on both the first temporary storage unit 44 and the second temporary storage unit 44 to the banknote storage bag 34, thereby completing the deposit processing. On the other hand, when the operator inputs a cancellation command of depositing to the controlling unit 80 through the operation/display unit 82, the storage operation is not performed. In this case, the operator can take out the banknotes held on the first temporary storage unit 44 and the second temporary storage unit 44 to the outside. At this time, since the deposited banknotes are kept on the first temporary storage unit 44 and the second temporary storage unit 44, the deposited banknotes can be taken out to the outside and returned to the operator without being mixed with the banknotes of the other processing.

As a sheet handling machine or sheet handling method according to the present invention, sheets other than the banknotes (for example, checks, vouchers) may be stored in a storage bag.

What is claimed is:

1. A sheet handling machine comprising:

a transporting unit configured to transport, one by one, sheets including first sheets and second sheets; and a plurality of sheet storage mechanisms each connected to the transporting unit, wherein the plurality of sheet storage mechanisms comprises:

a plurality of temporary storage units configured to temporarily hold the sheets transported from the transporting unit, the plurality of temporary storage units including a first temporary storage unit and a second temporary storage unit, wherein the first temporary storage unit is configured to temporarily hold the first sheets transported from the transporting unit, and the second temporary storage unit is configured to temporarily hold the second sheets transported from the transporting unit; and a plurality of storage units configured to store, therein, the sheets temporarily held by the plurality of temporary storage units, the plurality of storage units including a first storage unit and a second storage unit, wherein the first storage unit is configured to store the first sheets temporarily held by the first temporary storage unit, and the second storage unit is configured to store the second sheets temporarily held by the second temporary storage unit, and the sheet handling machine further comprises:

a controlling unit configured to control the transporting unit and temporary storage units to perform a parallel processing mode in which a transport operation of transporting the second sheets from the transporting unit to the second temporary storage unit one by one is performed in parallel with a storage operation of transporting the first sheets held by the first temporary storage unit to the first storage unit, and to perform a hold processing mode in which when the number of sheets transported from the transporting unit to the first temporary storage unit reaches a predetermined number, the transport operation is performed while the first temporary storage unit holds the first sheets transported from the transporting unit to the first temporary storage unit, wherein the controlling unit is configured to control the transporting unit and the temporary storage units such that in the hold processing mode, when all of the sheets to be stored in the storage units are held by the temporary storage units or when the first temporary storage unit and the second temporary storage unit become in a full state, the first sheets held by the first temporary storage unit are transported to the first storage unit and the second sheets held by the second temporary storage unit are transported to the second storage unit.

2. The sheet handling machine according to claim 1, wherein the sheets handled by the sheet handling machine are banknotes, and the controlling unit controls the transporting unit to transport the banknotes, from the transporting unit to each temporary storage unit such that banknotes of a plurality of denominations are stored in a mixed state in each of the storage units.

3. The sheet handling machine according to claim 1, wherein each of the plurality of storage units includes a mounting unit on which a storage bag provided with an opening for storing the sheets temporarily held by each of the plurality of temporary storage units is detachably mounted, and each mounting unit comprises a holding member for holding a portion of the storage bag near the opening of the storage bag.

4. The sheet handling machine according to claim 3, wherein each of the plurality of temporary storage units further comprises a pushing unit configured to enter an inside of the storage bag held by the holding member and push the sheets stored in the storage bag, wherein the storage operation comprises an operation of pushing the sheets stored in the storage bag by the pushing unit entering the inside of the storage bag.

5. The sheet handling machine according to claim 4, wherein the pushing unit further comprises a placement unit configured to be movable in a first direction in which the pushing unit enters the inside of the storage bag and pushes the sheets stored in the storage bag and on which at least a portion of the storage bag held by the holding member is placed, and the storage operation comprises an operation of moving the placement unit in the first direction.

6. The sheet handling machine according to claim 1, wherein each of the plurality of storage units includes a mounting unit at which a storage cassette for storing the sheets temporarily held by each of the plurality of temporary storage units is detachably mounted, and each mounting unit is provided with an accommodating space for accommodating the storage cassette.

7. The sheet handling machine according to claim 1, wherein each of the temporary storage units is arranged above each of the corresponding storage unit, each temporary storage unit comprises a temporary storage member which is rotatable about an axis of a shaft, the sheets transported from the transporting unit to each temporary storage unit are stacked on the corresponding temporary storage member, and the storage operation comprises an operation of transporting the sheets to the storage member mounted to the mounting unit, by dropping the sheets stacked on the temporary storage member as the temporary storage member rotates about the axis.

8. The sheet handling machine according to claim 1, wherein the controlling unit performs the hold processing mode when a predetermined condition based on a number of the first sheets transported from the transporting unit to the first temporary storage unit is satisfied.

9. The sheet handling machine according to claim 1, further comprising:

an inlet through which the sheets are taken in from outside into inside of the machine in deposit processing, wherein the transport unit is configured to transport, one by one, the sheets taken in through the inlet, wherein when an approval operation of the deposit processing, confirms the sheets to be stored in each of the storing units and confirmed sheets have not been held on the temporary storage units yet, the storage operation is continued.

10. The sheet handling machine according to claim 1, further comprising:

a setting unit configured to set one of the parallel processing mode and the hold processing mode.

11. The sheet handling machine according to claim 1, wherein in the hold processing mode, when the first temporary storage unit and the second temporary storage unit become in a full state, it becomes impossible to hold the sheets any more on each temporary storage unit.

* * * * *